US005440137A

United States Patent [19]

Sowers

[11] Patent Number: 5,440,137

[45] Date of Patent: Aug. 8, 1995

[54] SCREW MECHANISM FOR RADIATION-CURING LAMP HAVING AN ADJUSTABLE IRRADIATION AREA

[75] Inventor: Kenneth G. Sowers, Walkersville, Md.

[73] Assignee: Fusion Systems Corporation, Rockville, Md.

[21] Appl. No.: 301,107

[22] Filed: Sep. 6, 1994

[51] Int. Cl.[6] ..... H05B 31/04

[52] U.S. Cl. ..... 250/504 R; 250/503.1; 362/270; 362/289

[58] Field of Search ..... 250/504 R, 503.1, 493.1; 362/220, 269, 270, 285, 289, 372

[56] References Cited

U.S. PATENT DOCUMENTS

| | | | |
|---|---|---|---|
| 2,928,934 | 10/1960 | Atkin . | |
| 3,826,014 | 7/1974 | Helding . | |
| 3,872,349 | 3/1975 | Spero et al. . | |
| 4,042,850 | 8/1977 | Ury et al. . | |
| 4,208,587 | 6/1980 | Eastlund et al. . | |
| 4,504,768 | 3/1985 | Ury et al. . | |
| 4,855,884 | 8/1989 | Richardson | 362/289 |
| 5,017,327 | 5/1991 | Bamser | 362/289 |

FOREIGN PATENT DOCUMENTS

| | | | |
|---|---|---|---|
| 3347254 | 7/1985 | Germany | 250/504 R |

OTHER PUBLICATIONS

"Fusion Systems Benchtop Conveyor Model MC-6" published May 1986, by Fusion UV Curing Systems.

"Fusion UV Curing Systems Model MC-6R Benchtop Conveyor" published Jan. 1993, by Fusion UV Curing Systems.

Manual No. 236481 Rev. A for "MC-6 Benchtop Conveyor" published Jan. 1990, by Fusion UV Curing Systems.

*Primary Examiner*—Jack I. Berman
*Assistant Examiner*—James Beyer
*Attorney, Agent, or Firm*—Pollock, Vande Sande & Priddy

[57] ABSTRACT

An apparatus and method for curing radiation curable material includes a lamp unit providing radiation in a converging beam directed toward a focal plane and forming a curing zone at a curing position for receiving the curable material. The lamp unit is mounted in a boot member having a spiral external thread for engaging a spiral internal thread on the wall of a housing chamber for receiving the boot member. The engagement of the threads is such that rotation of the boot member controllably varies the intensity of radiation in the curing zone by changing the distance between the radiation outlet of the lamp unit and the curing position. The curing zone may be an elongated band such that rotation of the boot member also provides angular adjustment of the elongated band relative to a curing path for the curable material. The boot member may include internal cooling passages and these passages may contain overlapping light baffles blocking the escape of harmful radiation.

16 Claims, 4 Drawing Sheets

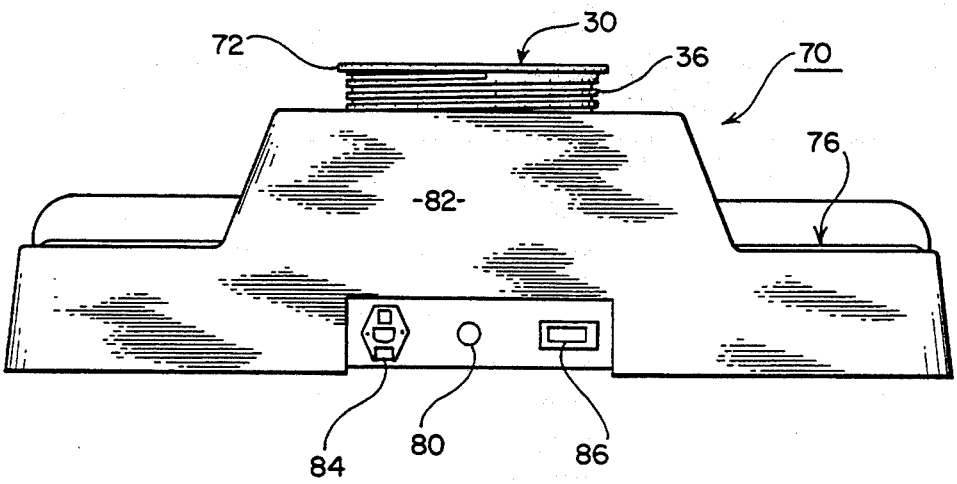
FIG. 7
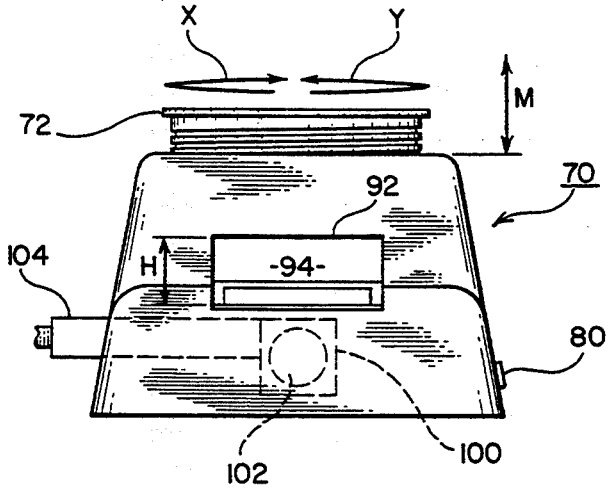
FIG. 8
FIG. 9
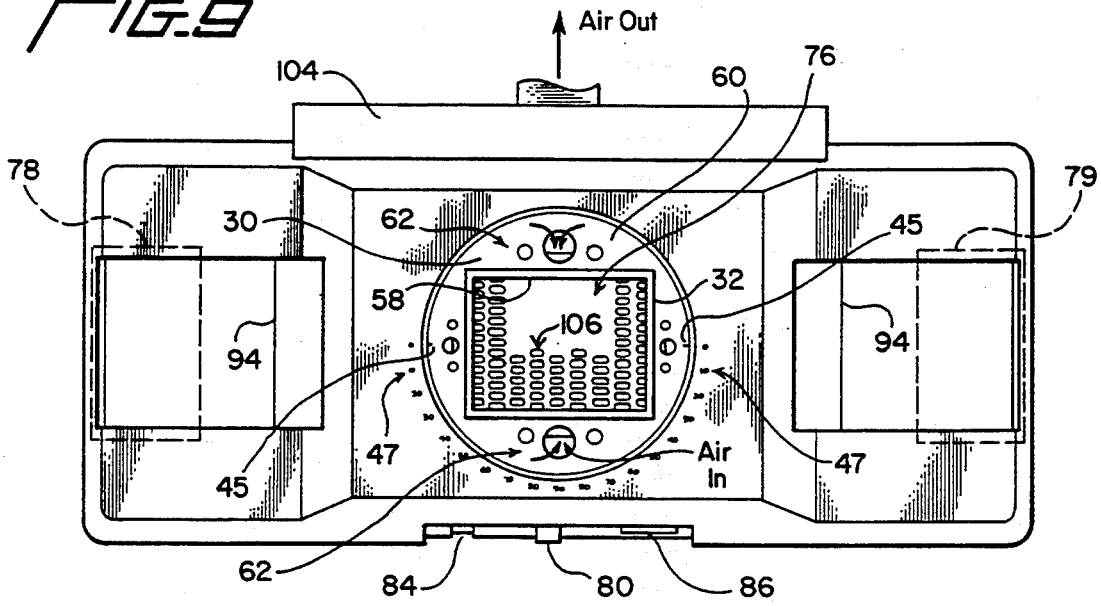

SCREW MECHANISM FOR RADIATION-CURING LAMP HAVING AN ADJUSTABLE IRRADIATION AREA

FIELD OF THE INVENTION

The present invention relates to a method and apparatus for curing a coating material with radiation, such as ultraviolet radiation. More particularly, the invention is directed to a method and apparatus for making precise adjustments in the intensity of the curing zone of a converging beam of radiation impinging upon a radiation curable coating supported on a substrate.

BACKGROUND OF THE INVENTION

The graphic arts and packaging industries utilize a process referred to as ultraviolet curing to avoid problems caused by strict emission control standards and energy costs associated with the drying of inks and other coatings containing volatile solvents. Curing solvent-free inks and other coatings may be achieved by a photopolymerization reaction induced by ultraviolet light, which changes a component of the ink or coating from a liquid to a solid state almost instantaneously. Since these inks and coatings do not contain solvents and are quickly cured, this curing technique is essentially pollution-free and energy efficient.

As will be described further below, to provide for maximum intensity radiation, lamps for ultraviolet curing are typically highly focused units with the coating to be cured being placed precisely in the focal plane containing the highest intensity radiation, which may heat the coating to a high temperature. While this arrangement works well in the curing of coatings with high temperature resistance, many inks and coatings are susceptible to rapid degradation at high temperatures and therefore need to be cured with less intense radiation and cooler temperatures.

Since the energy output of many ultraviolet lamps, particularly those of the electrodeless type, cannot be changed significantly without risk of extinguishing the bulb of the lamp, the intensity of the radiation impinging on the coated substrate of a product is best varied by changing the distance between the lamp outlet and the coated substrate so that the latter is no longer precisely in the focal plane. However, ultraviolet lamp units may be relatively heavy and known means for adjusting the distance between the lamp outlet and the irradiated surface have proven to be cumbersome, time consuming and imprecise.

In addition, many ultraviolet lamp units have an elongated rectangular shape such that the lamp outlet and the radiation beam it produces have a long dimension substantially longer than a short dimension. It may therefore be desirable to rotate the longitudinal axis of the lamp relative to a dimension of the coated substrate to be treated. For example, when treating an elongated strip having a width less than the long dimension of the lamp, it may be desirable to place the longitudinal axis of the lamp at an acute angle relative to the direction of the translational path of the strip to maximize the amount of radiant energy impinging on the strip and thereby minimize the amount of radiant energy bypassing the strip so as to be wasted by heating underlying structure and/or components which may be heat sensitive. In other words, if an elongated strip, a continuous web or other product carrying the coating material to be cured is narrower than the longitudinal spread of the radiation beam provided by the lamp unit, the portions of the beam passing beyond the edges of the product may undesirably impinge upon and heat underlying parts of the housing opposite to the lamp unit outlet. Prior art techniques for rotating the lamp axis relative to the translational path of the product have also proven to be cumbersome, time consuming and imprecise.

SUMMARY OF THE INVENTION

It is therefore a principal object of the present invention to provide a method and apparatus for precisely adjusting the distance between a lamp unit emitting a converging beam of radiation and a coating to be cured by the radiation beam.

Another object of the invention is to provide a support mechanism for supporting a curing lamp unit in a manner that allows a smoothly continuous focus adjustment of a converging beam of radiation emitted by the lamp unit, and provides a radiation tight seal between the support mechanism and a housing defining a curing chamber.

A further object of the invention is to provide a support vessel having a hollow central cavity for holding a curing lamp unit, and external threads for engaging a threaded housing wall to allow for both vertical and angular adjustment of the lamp unit to change the focus of a converging beam of radiation relative to a curable coating supported by a substrate.

A still further object of the invention is to provide a method and apparatus for precisely adjusting the angle between the longitudinal axis of an elongated band of curing radiation and the translational path of a product having a coating to be irradiated by the radiation band so as to minimize the amount of radiation bypassing the product where the width of the product is substantially less than the long dimension of the radiation band.

Although the invention may be used for curing other types of coatings with other types of radiation, the invention is particularly useful for high speed curing of solvent-free coating material with high-power ultraviolet radiation which is directed at the solvent-free coating shortly after its application to the substrate or body of a product. The ultraviolet radiation for curing the solvent-free material may be produced by radiation emitting tubes of various shapes, and may be directed and concentrated by reflectors of corresponding shapes.

One such tube is an elongated lamp bulb that extends transversely to the direction of movement of the coated substrate and is preferably of the electrodeless type. Associated with this lamp bulb is an elliptical reflector for concentrating the radiation into a two-dimensional elongated band which may be very narrow and impinges upon the coated substrate when the latter is placed in or passes through a curing position opposite the lamp unit. This curing position may be a rest position or located along a translational path through a housing supporting the lamp unit.

The lamp unit is mounted in the housing by means of a hollow screw or boot having a cavity for receiving the casing of the lamp unit and an exterior cylindrical wall with a spiral thread for engaging a corresponding spiral thread on an interior cylindrical wall of the housing which defines an internal chamber for receiving the threaded boot. The pitch of the threads on the respective boot and housing walls is such that rotation of the boot within the housing provides a gradual and precise axial adjustment that varies the distance between the lamp outlet and the coated substrate.

Because the radiation is formed into a converging beam by the elliptical reflector, the invention changes the intensity of the curing band of radiation by axially adjusting the threaded boot so that the curing band of radiation at the coated surface of the substrate is somewhere between the focal plane of maximum intensity radiation and the opposing radiation outlet of the lamp unit, which may be covered by the mesh of an RF screen. For example, the focal plane may be about six inches from the lamp unit outlet and the distance from the lamp unit outlet to the substrate may be adjustable from about six inches where the coated substrate is in the focal plane to about two inches where the focal plane is about four inches beyond the coated substrate.

It follows that, in addition to preventing overheating of a heat sensitive coating, the curing apparatus in accordance with the invention may provide different degrees of curing depending upon the distance between the lamp unit outlet and the coated substrate. Thus, in certain applications, it may be desirable to partially cure a solvent-free, radiation curable material after the performance of certain steps and then to complete the cure of this material after completion of additional steps. For example, in a multi-coating operation, radiation may be used to only partially cure the material of each coat after that coat has been applied. Thereafter, a more intense curing band of radiation may be used to completely cure the coated substrate after all of the coatings have been applied.

Another important advantage of the invention is that the threaded boot may be rotated to pivot the lamp and thereby change the angle between its longitudinal axis and the travel path of the product to be cured. Thus, boot rotation also provides a precise pivotal adjustment that varies the angle between the lamp axis and the translational path of the substrate. This feature allows fine adjustment of the residence time that a moving product remains in the curing band of radiation. It is also useful where a strip or web carrying the coating material is narrower than the longitudinal spread of the radiation from the lamp outlet. In this situation, the angle is changed to insure that most of the radiation will be intercepted by the strip or web, thereby preventing excessive radiation from bypassing the strip or web and reaching an underlying area of the housing which may contain components susceptible to damage by such radiation.

Cooling slots and holes are disposed in the lamp unit and its reflector to permit these components to be cooled by air pulled through these cooling slots and holes. The threaded boot for receiving the lamp unit preferably contains similar openings and air flow passages so that air may be pulled through these openings and passages and into the housing by an air exhaust system connected to the housing. This circulating air flow will cool the boot sufficiently to prevent its overheating. Although the air cooling systems for the lamp unit and for the threaded boot also exhaust heated gas from the vicinity of the lamp, these systems do not significantly cool the lamp bulb itself since this may hinder its proper operation.

The air passages of the threaded boot contain overlapping light baffles that are arranged so that these solid portions of the boot block stray radiation and prevent any direct viewing of reflected radiation generated by the lamp. Such stray or reflected radiation could be harmful to persons using or standing near the apparatus. On the other hand, the lamp unit may merely rest in the boot cavity and is therefore easily removed for cleaning and maintenance. The threaded boot may also be readily unscrewed from the housing to permit easy access into the housing for internal repair and maintenance.

BRIEF DESCRIPTION OF THE DRAWINGS

The invention, both as to its structure and operation, may be further understood by reference to the detailed description below taken in conjunction with the accompanying drawings in which:

FIG. 7 is a side elevational view of the exterior of the apparatus of FIG. 6;

FIG. 8 is a left end view of the apparatus of FIG. 6; and,

FIG. 9 is a top plan view of the apparatus of FIG. 6.

DETAILED DESCRIPTION OF THE INVENTION

Figure 1:
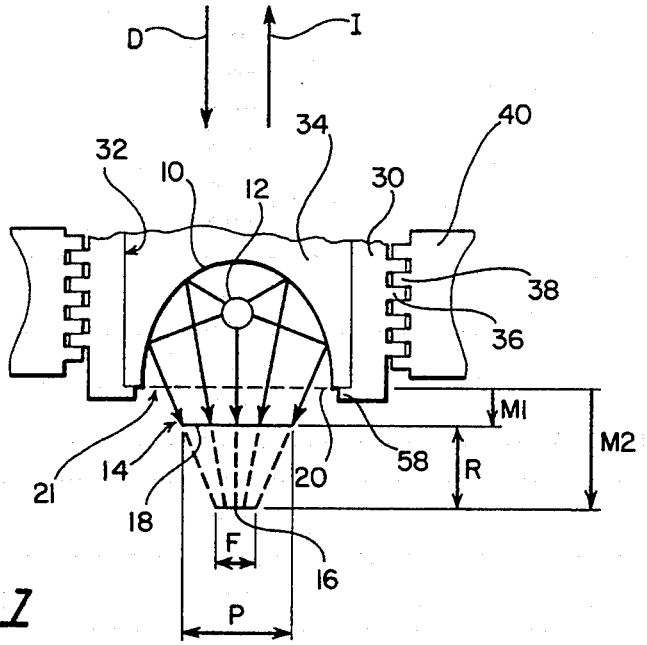
FIG. 1 is a diagrammatic end view of the lamp unit and its mounting boot illustrating geometric aspects of the curing technique of the invention.

Referring to FIG. 1, there is shown diagrammatically a typical light source which may be used for ultraviolet (UV) curing of UV curable material and comprises a reflector 10 and a lamp bulb 12. The reflector 10 is used to focus the UV light radiation from the lamp bulb 12 into a converging beam 14 which reaches its highest intensity as an elongated band of radiation at a focal plane 16. Radiation bands of less intensity, such as curing band 18, occur intermediately between the focal plane 16 and the radiation outlet 21 of the lamp unit, which may be covered by an RF screen 20.

Figure 2:
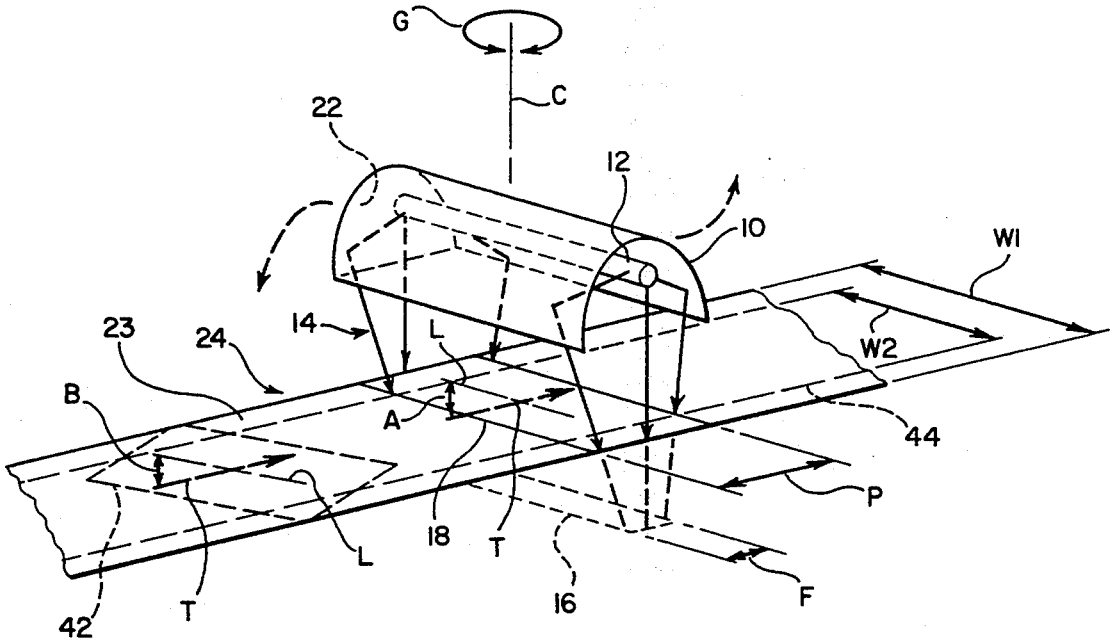
FIG. 2 is a diagrammatic perspective view illustrating geometric aspects of the curing technique and of partially rotating the lamp unit to change the angle between the longitudinal axis of the radiation band and the translational path of the coated substrate.

Each band of radiation has a substantially constant length dimension, as defined by end reflectors 22 at each end of the elliptical reflector 10, and a width dimension that varies with the distance of the radiation band from the outlet 21 of the lamp unit as illustrated best in FIG. 2. For example, the fully focused radiation band 16 in the focal plane may have width F, while the partially focused radiation in the curing band 18 may have a greater width P.

Typically, the reflector 10 is a half-ellipse in transverse cross section with the longitudinal axis of the lamp bulb 12 lying along the locus of the foci of a longitudinal cross section of the reflector 10. A substrate strip or web 24 on which a UV-curable ink or coating 23 has been applied passes through a curing zone or band 18 of UV radiation, which is intermediate between radiation outlet 21 and the highest intensity radiation band 16 which occurs at the other foci of the ellipse.

The band 16 defines the focal plane and constitutes a relatively narrow (typically one-half inch wide) band of very high intensity radiation having a length substantially equal to the length of the lamp bulb 12.

The cure rates of many of the inks and coatings to be polymerized by the curing band 18 depend on the intensity of the ultraviolet radiation in this band. Because of this, the intensity must be carefully controlled. In addition, many such materials exhibit an intensity threshold below which effective curing does not take place. Accordingly, the coated substrate must pass through a radiation band sufficiently close to the other foci of the ellipse such that the intensity of the radiation in the curing band 18 at least achieves, and preferably exceeds, the intensity threshold required to cure the coating material. On the other hand, the intensity of the radiation in the radiation band at the focal plane 16 may cause excessive heating and undesirable degradation of the coating material, at least at or near its exposed surface.

The invention therefore provides a mechanism for precisely adjusting the distance between the radiation outlet 21 of the lamp unit and the curing position for receiving the surface 23 of the coated substrate, this position coinciding with the curing band 18 shown in FIG. 2. The mechanism provided thereby accurately controls the intensity of the radiation in the curing band impinging on that portion of the surface of the polymerizable coating which is in the curing position opposite to the radiation outlet 21.

Figure 3:
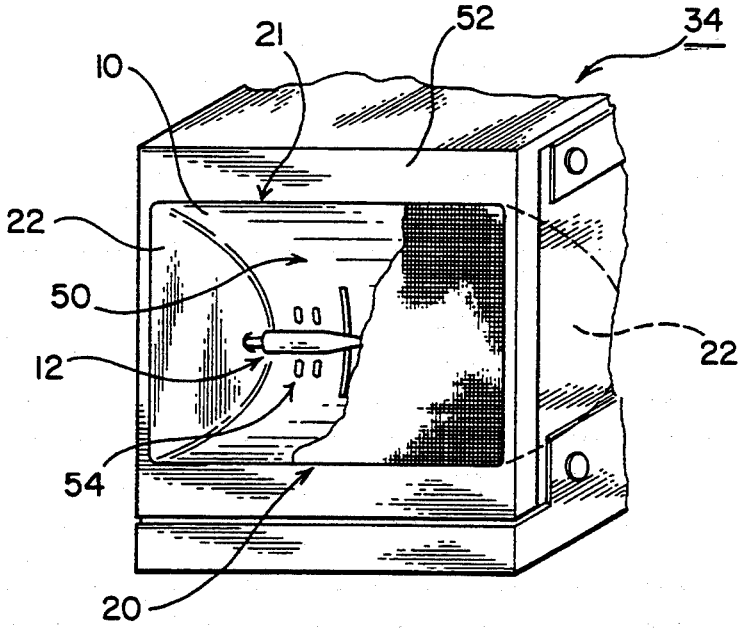
FIG. 3 is a perspective view of the lamp unit looking towards the radiation outlet at the bottom thereof.
Figure 4:
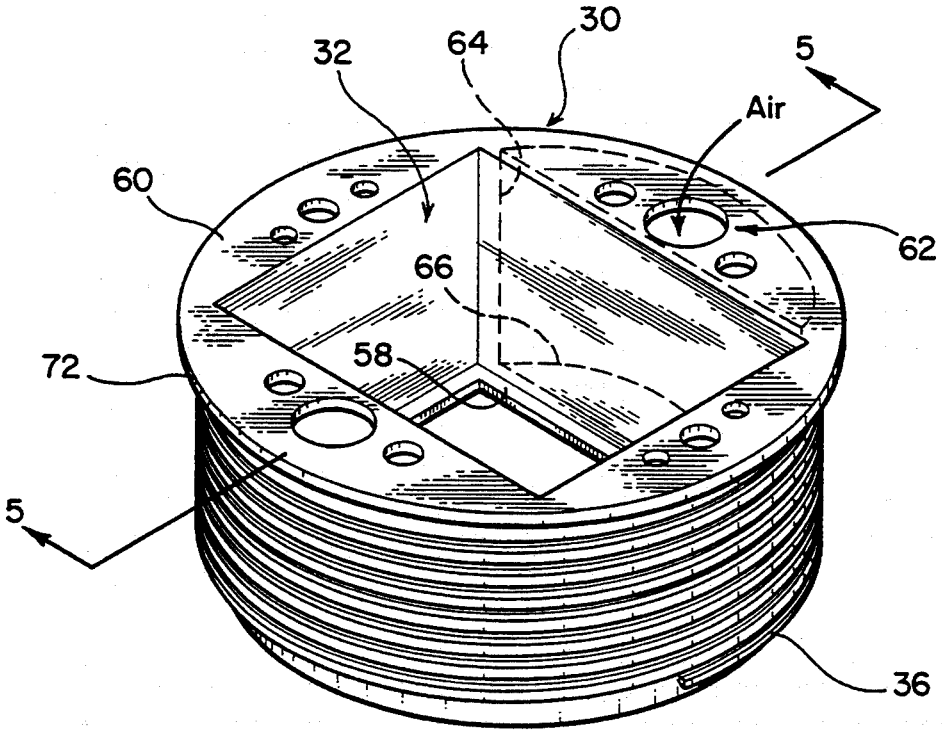
FIG. 4 is a perspective view of the threaded boot showing the cavity for receiving the lamp unit of FIG. 3.

Referring now to FIGS. 1, 3 and 4, the adjusting mechanism comprises a boot member 30 having a central cavity 32 for receiving and supporting an entire lamp unit 34. The boot 30 has a continuous spiral thread 36 for engaging a corresponding spiral thread 38 on a curing unit housing 40. The threads 36 and 38 are preferably arranged to permit consecutive 360° rotations of boot 30 relative to housing 40, and these threads have a pitch that gives the desired rate of ascent and descent of the radiation outlet 21 per 360° revolution of the boot 30 relative to housing 40.

Figure 6:
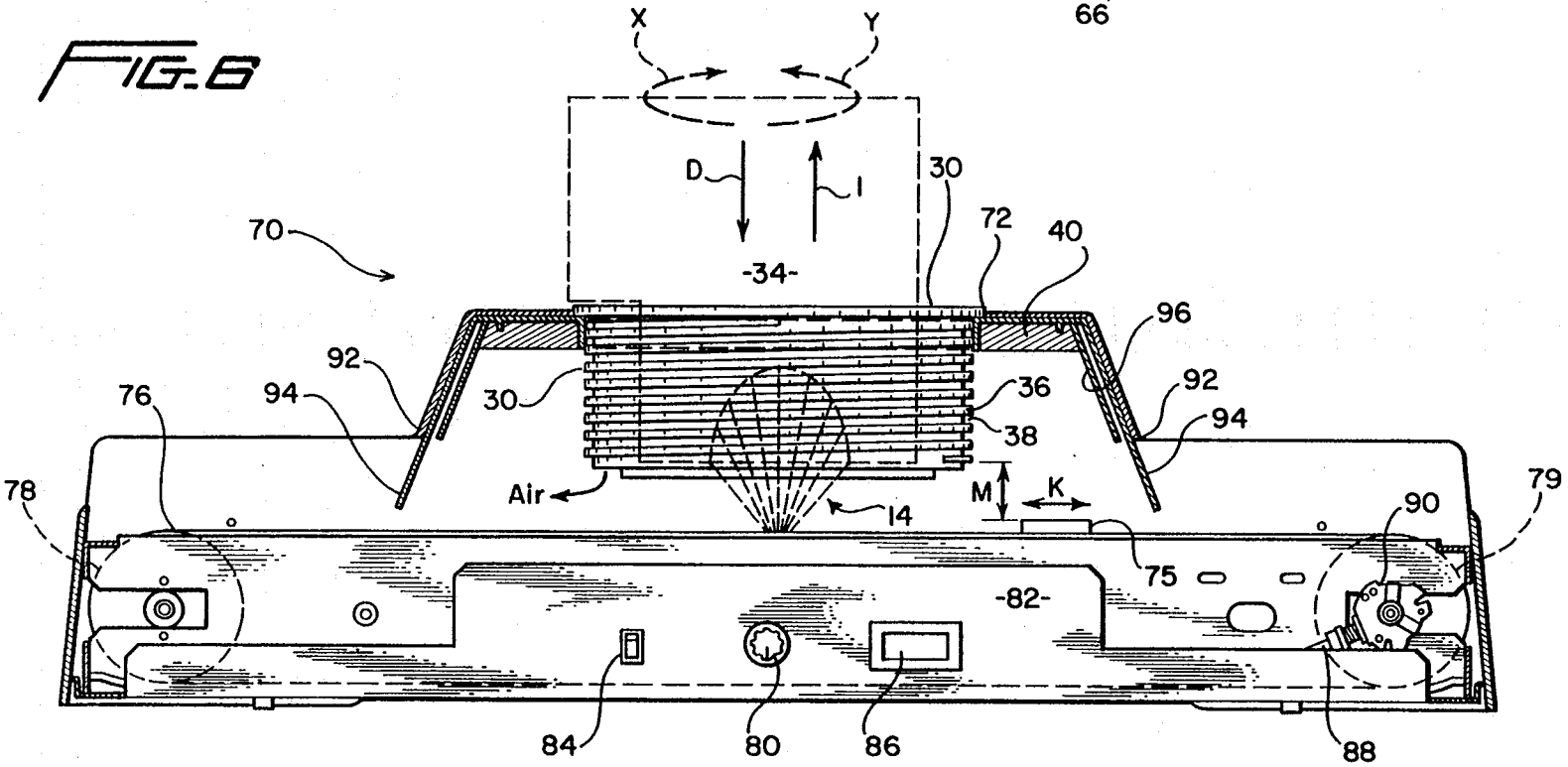
FIG. 6 is a partial sectional view in side elevation of an apparatus constructed in accordance with one embodiment of the invention.

Preferably, the thread pitch is sufficiently gradual to provide very fine adjustments of the distance between the radiation outlet 21 of the lamp unit and the curing position for the coated substrate, this distance being represented by the double-ended arrow M in FIG. 6, and being adjustable over a range represented by the double-ended arrow R from a minimum distance M1 to a maximum distance M2 as illustrated in FIG. 1. For a six inch (6″) Fusion System electrodeless lamp unit, the minimum distance M1 is preferably about 2.1 inches and the maximum distance M2 is preferably about 6.1 inches, such that the adjustment range R is about 4.0 inches.

The present invention therefore provides a means for locating the coating to be cured substantially closer to the radiation outlet of the lamp unit than the focal plane thereof. This is illustrated diagrammatically in FIGS. 1 and 2. By locating the uncured coating substantially closer to the radiation outlet than the focal plane, the invention utilizes the partially focused light rays emitted by the lamp unit to cure the coating with less intense radiation. The radiation in the resulting curing band also has a greater area of coverage than the radiation band at the focal plane. Thus, in FIG. 2, it may be seen that the area covered by the radiation band 18 of partially focused light rays is significantly larger than the area of the highly focused radiation band 16 at the focal plane. It is also to be noted that, although fewer rays per unit area may result in less intensity, the drop in intensity is to some extent counteracted by the fact that the surface of the coating is closer to the radiation outlet of the lamp unit, which insures a high enough intensity for effective curing of the coating material.

As also shown in FIG. 2, the longitudinal axis L of the lamp bulb 12 may normally be transverse to the translational direction T of substrate strip 24, such that the angle A between the lamp axis L and the translational direction T is about 90° as represented by the angle A. As also indicated in this figure, boot 30 permits the lamp unit to be rotated in either direction as indicated by the double-ended arrow G around the rotational axis C of boot 30. In addition to providing the distance adjustments indicated above, this feature also provides for canting the longitudinal axis L of the lamp unit at an acute angle relative to the translational direction T as indicated by the acute angle B. This creates an alternative curing band 42 of radiation for curing an alternate coated strip 44, which has a width W2 substantially less than the width W1 of strip 24 because strip 44 is substantially more narrow than strip 24.

As illustrated in FIG. 9, the value of the acute angle B may be indicated by a pair of index marks 45, 45 at the peripheral edge of the upper surface 60 of boot 30 and two sets of corresponding adjacent indicia 47, 47 on the upper surface of the housing 82 of curing apparatus 70. For example, each of the indicia 47 may be in 10° increments from 0° to 90° for rotation of the boot 30 in either direction.

Lamp unit 34 is preferably an electrodeless radiation apparatus in which the UV radiation emitted by lamp bulb 12 is generated by microwave radiation within a microwave chamber 50 defined by the elliptical shaped rear reflector 10 and the pair of end reflectors 22, 22 mounted in a casing 52. The end reflectors 22, 22 of the lamp unit 34 are preferably such that the length dimensions of the respective radiation bands 16 and 18, as well as the radiation bands intermediate thereto, as defined by the limits of converging radiation beam 14, are substantially equal to the width W1 of substrate strip 24, which represents the widest strip for which the curing apparatus described below is designed to process.

The lamp unit 34 also includes a RF screen 20 covering the radiation outlet 21, cooling air holes 54, and microwave generating components (not shown) located behind rear reflector 10. Microwave chamber 50 may be arranged to reduce the effective propagation of the microwave radiation employed until the plasma forming medium in the lamp bulb 12 is energized and becomes a plasma in accordance with the teachings of Fusion Systems U.S. Pat. No. 4,042,850, the entire contents of which are expressly incorporated herein by reference. A lamp unit such as disclosed in Fusion Systems U.S. Pat. No. 4,504,768 also may be used, and the entire contents of this patent are expressly incorporated herein by reference.

Figure 5:
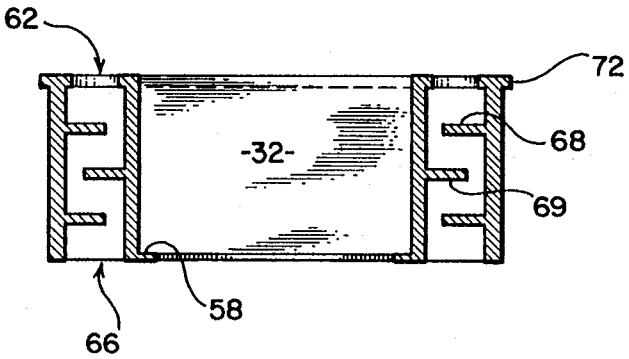
FIG. 5 is a sectional view taken along lines 5—5 of FIG. 4.

In FIG. 4, there is clearly shown the cavity 32 for receiving the lamp unit 34 so that the frame 52 around the lamp outlet 21 rests on a ledge 58 at the bottom of cavity 32. As also shown in this figure, the upper surface 60 of boot 30 has four sets of air openings 62 each leading to an internal cooling chamber 64 having an outlet opening 66 in the bottom surface of the boot. To insure a light seal for preventing the escape of any harmful ultraviolet radiation, the four respective cooling chambers 64 each have a series of overlapping light baffles 68 and 69 as shown in FIG. 5.

Referring now to FIG. 6, the boot 30 is threaded into the housing wall 40 of a curing apparatus, generally designated 70. The boot 30 has an outwardly projecting peripheral lip 72 at the top thereof which acts as a stop to limit the inward travel of the boot when it engages the upper surface of housing wall 40. The curing apparatus 70 treats a product 75, which is a substrate having a radiation curable coating at least on its upper surface. The product 75 may have any shape, but is often elongated in the translational direction T of the travel path, such as a continuous web or an elongated strip of predetermined length. The ink or coating used on product 75 is preferably a conventional solvent-free radiation curable material which is cured through photopolymerization by radiant energy in the ultraviolet light beam 14 emitted by lamp unit 34.

The product substrate must be capable of receiving a radiation curable ink or other coating and this coating is applied before the product is conveyed through the curing apparatus 70. The coated product is then placed on a conveyor belt 76 which may be driven in either direction as indicated by the double-ended arrow K by a pair of motor driven pulleys 78 and 79. The speed and direction of belt 76 is controlled by a speed control knob 80 on an exterior portion of the housing 82 of apparatus 70. The exterior of housing 82 also includes an IEC power entry socket 84 and a digital speed readout 86 which displays the translational speed of the conveyor belt 76. The speed readout 86 is connected by a cable 88 to a speed sensor 90 surrounding the shaft of pulley 79.

The boot thread 36 and the housing thread 38 are preferably right handed so that clockwise rotation of the boot 30 with the lamp unit 34 mounted therein in the direction of arrow X causes the lamp unit 34 to descend in the direction of arrow D, and counterclockwise rotation of the boot 30 in the direction of arrow Y causes the lamp unit to ascend in the direction of arrow I. Such movements of the lamp unit provide the adjustments in the intensity and orientation of the radiation band 18 impinging upon the product 75 as described above in connection with FIGS. 1 and 2, wherein the product 75 is represented by elongated strip 24 or 44.

It follows from the foregoing that the total amount of radiation impinging upon the two-dimensional area of the curing position for receiving a corresponding area at the surface of coated product 75 may be adjusted by two separate means, which may be used independently or in combination. The first of these is by means of controlling the speed of the conveyor 76 and thereby the residence time within the radiation beam 14 of any point in the surface area of the product. The second of these is by means of controlling the width of the radiation band through which the product is conveyed by the belt 76 by changing the vertical distance between the radiation outlet and the surface of the coated product. This variable irradiation distance is designated M in FIG. 6 and the range of change therein is designated R in FIG. 1.

While the boot 30 is in its lowermost position as shown in FIG. 6, the radiation intensity in curing band 18 is at its lowest level. By raising boot 30 to an intermediate position as illustrated in FIGS. 7 and 8, the radiation intensity in curing band 18 is increased. In FIGS. 7–9, the lamp unit 34 has been removed from the boot to simplify these illustrations. The end view of FIG. 8 illustrates that the overall focus adjustment represented by the double-ended arrow M may be about four inches, for example, and that the height H of the entrance and exit openings 92, 92 in the housing 82 defines the maximum height, such as about three inches for example, of the product 75 to be treated.

FIGS. 6 and 8 also illustrate a vertically adjustable radiation or ultraviolet light shield 94 which slides along a track 96 within the upper portion of housing 82. Light shield 94 is held in the desired vertical position by a clamping mechanism (not shown) so that the bottom edge of the light shield will just be clear of the top of the product 75 as it is conveyed beneath the light shield by conveyor 76. As explained earlier, both the periphery of the boot 30 and the air openings 62 and passages 64 are "light tight" the light seal for the periphery of the boot being provided by engagement of the threads 36 and 38 and the light seal for the air openings and passages being provided by the light baffles 68 and 69.

As illustrated in FIG. 8, a centrifugal air blower 100 driven by a motor 102 is mounted within housing 82 and exhausts heated air through an external air duct 104. Ambient air for cooling is drawn through housing 82 via various air inlet openings, such as the openings 62 in boot 30 and the area beneath the light shields 94, 94, which only partially cover the entrance/exit openings 92, 92 of housing 82. The blower 100 is preferably located under conveyor belt 76 and is elongated in the translational direction thereof. Belt 76 may be perforated as illustrated by multiple holes 106 in FIG. 9 so that cooling air passes directly through the belt and into an elongated blower inlet (not shown). This air cooling system exhausts heated gas and ozone from the vicinity of the radiation beam 14. However, the various inlet openings and passages for cooling air are arranged so as not to significantly cool the bulb 12 within the lamp unit 34, as excessive cooling thereof would interfere with its proper operation.

Although the invention has been illustrated in conjunction with a conveyor belt for providing translational movement past the radiation outlet of the lamp unit, other means of product movement may be used, or the product itself may be stationery, in which case the lamp unit may be moved in relation thereto or the lamp may be activated only for the period of time required for product treatment. Furthermore, the invention is not limited to a lamp unit or a curing zone of any particular shape or to curing any particular product or a product having any particular shape, although it has been illustrated in conjunction with an elongated curing band and elongated products such as webs or strips. For example, both the lamp bulb and the curing zone could be circular or annular. The essential requirement of the present invention is only that the radiation be directed from the radiation outlet as a converging beam, and that the spatial distance between the radiation outlet and the surface to be irradiated may be changed by rotating a lamp supporting member having threads engaged with corresponding threads of a housing or other means for mounting the lamp supporting member.

It therefore follows that, although the preferred embodiments of the invention have been disclosed and described, the invention includes all embodiments thereof which would be apparent to one skilled in the art and which come within the spirit and scope of the claims set forth below.

What is claimed is:

1. An apparatus for curing a coating material on a substrate, said apparatus comprising:

radiation means including a lamp bulb for emitting a curing radiation and directional means for directing the radiation from said lamp bulb through an outlet in a converging beam such that said radiation converges toward a focal plane and forms a zone of curing radiation at a curing position opposite to said radiation outlet, said radiation zone having a dimension varying with the distance between said radiation outlet and said curing position;

housing means including means for supporting said coated substrate in said curing position during the curing of said coating material by said radiation zone; and, means for mounting said radiation means on said housing and comprising boot means having a cavity for receiving and supporting said radiation means with said radiation outlet in spaced relation opposite to said curing position, and a cylindrical housing wall having internal threads and defining a chamber in said housing means for receiving said boot means, said boot means having a cylindrical outer surface and external threads on said outer surface for engaging the internal threads of said housing wall, the engagement of said threads being such that rotation of said boot means controllably varies said radiation zone dimension by changing the distance between said radiation outlet and said curing position, and the rotational position of said boot means being selectable such that the intensity of said radiation zone is sufficient to at least partially cure said coating material while said coated substrate is in said curing position.

2. An apparatus according to claim 1 wherein said housing has an inlet and an outlet and defines a curing path extending from said inlet to said outlet, said curing path including said curing position; and wherein said apparatus further comprises conveying means for moving said coated substrate along said curing path and past said curing position.

3. An apparatus according to claim 2 wherein said conveying means includes speed control means for varying a residence time that said coated substrate is in said curing position.

4. An apparatus according to claim 1 wherein said directional means provides peak intensity radiation when said radiation zone is at said focal plane, and wherein the threaded engagement between said boot means and said housing wall is such that said focal plane may be moved from said curing position to a position substantially beyond said curing position by rotation of said boot means.

5. An apparatus according to claim 4 wherein said lamp bulb is elongated and said directional means is an elongated elliptical reflector such that said radiation zone is an elongated radiation band.

6. An apparatus according to claim 5 wherein said lamp bulb is of an electrodeless type and said radiation is in an ultraviolet range.

7. An apparatus according to claim 6 wherein said threaded engagement provides a range of said movement of the focal plane between at least about two inches and about six inches from the outlet of said radiation means.

8. An apparatus according to claim 1 wherein said boot means is removable from said housing chamber by said rotation to provide access to the interior of said housing.

9. An apparatus according to claim 1 wherein said radiation means is removable from the cavity of said boot means to provide access to the interior of said housing and to the lamp bulb of said radiation means.

10. An apparatus according to claim 1 wherein said boot means further comprises fluid passage means, and wherein said apparatus further comprises cooling means in fluid communication with the fluid passage means of said boot means for cooling the same when heated by said radiation means.

11. An apparatus according to claim 10 wherein said fluid passage means comprises an inlet opening and an outlet opening, and at least one internal air flow passage connecting said inlet and outlet openings, and wherein said cooling means comprises air exhausting means for drawing air through said inlet and outlet openings and said air flow passage.

12. An apparatus according to claim 11 wherein said boot means further comprises radiation baffle means arranged in said air flow passage to provide a radiation seal for preventing said radiation from escaping through said air flow passage.

13. An apparatus according to claim 1 wherein said threaded engagement is such that said internal and external threads provide a radiation seal for preventing said radiation from escaping between the cylindrical wall of said boot means and the cylindrical wall of said housing chamber.

14. An apparatus for curing a coating material on a substrate, said apparatus comprising:

radiation means including a lamp bulb for emitting a curing radiation and directional means for directing the radiation from said lamp bulb through an outlet in a converging beam such that said radiation converges toward a focal plane and forms an elongated radiation band having a length dimension substantially greater than a width dimension at a curing position opposite to said radiation outlet, said width dimension varying with the distance between said radiation outlet and said curing position;

housing means including means for supporting said coated substrate in said curing position during the curing of said coating material by said radiation band; and, means for mounting said radiation means on said housing and comprising boot means having a cavity for receiving and supporting said radiation means with said radiation outlet in spaced relation opposite to said curing position, and a cylindrical housing wall having internal threads and defining a chamber in said housing means for receiving said boot means, said boot means having a cylindrical outer surface and external threads on said outer surface for engaging the internal threads of said housing wall, the engagement of said threads being such that rotation of said boot means controllably varies the width of said radiation band by changing the distance between said radiation outlet and said curing position, and the rotational position of said boot means being selectable such that the intensity of said radiation band is sufficient to at least partially cure said coating material while said coated substrate is in said curing position.

15. An apparatus according to claim 14 wherein said housing has an inlet and an outlet and defines a curing path extending from said inlet to said outlet, said curing path including said curing position; wherein said apparatus further comprises conveying means for moving said coated substrate along said curing path and past said curing position; wherein said substrate has a transverse dimension and said conveyor means moves said substrate along said curing path so that said transverse dimension is substantially perpendicular to a translational direction of said curing path; wherein said radiation outlet is oriented so that the length dimension of said radiation band forms an angle of between 0° and 90° with said translational direction and a change in the rotational position of said boot causes a corresponding change in said angle; and wherein the length dimension of said radiation band is at least equal to a width of said curing position such that rotation of said boot means will change said angle so that the ends of said radiation band may be made to substantially coincide with the transverse dimension of said substrate when said transverse dimension is substantially less than the width of said curing position.

16. A method for adjusting the intensity of radiation provided by radiation means for curing a coating material on a substrate, said radiation means including a lamp bulb for emitting said radiation and directional means for directing the radiation from said lamp bulb through an outlet in a converging beam such that said radiation converges toward a focal plane, and said method comprising:

supporting said radiation means on a housing by mounting means so that said converging beam forms a zone of curing radiation at a curing position opposite to said radiation outlet and said radiation zone has a dimension varying with the distance between said radiation outlet and said curing position, said mounting means comprising boot means having a cavity supporting said radiation means with said radiation outlet in spaced relation opposite to said curing position, and a cylindrical housing wall having internal threads and defining a chamber in said housing means receiving said boot means, said boot means having a cylindrical outer surface and external threads on said outer surface engaged with the internal threads of said housing wall;

supporting said coated substrate in said curing position for the curing of said coating material by said radiation zone;

activating said radiation means so that said curing radiation is emitted by said lamp bulb and directed by said directional means; and, rotating said boot means relative to said housing wall while said threads are engaged with each other, the engagement of said threads being such that said rotation of said boot means controllably varies the intensity of said radiation zone by changing the distance between said radiation outlet and said curing position to produce a corresponding change in said radiation zone dimension, and the rotational position of said boot means being selectable such that the intensity of said radiation zone is sufficient to at least partially cure said coating material while said coated substrate is in said curing position.

* * * * *